US008773322B2

(12) United States Patent
Wong et al.

(10) Patent No.: US 8,773,322 B2
(45) Date of Patent: Jul. 8, 2014

(54) HIGH PERFORMANCE HDTV ANTENNA DESIGN AND FABRICATION

(76) Inventors: Gary Gwoon Wong, Torrance, CA (US); Calvin Gwoon Wong, Torrance, CA (US); Kalem Gwoon Wong, Torrance, CA (US)

( * ) Notice: Subject to any disclaimer, the term of this patent is extended or adjusted under 35 U.S.C. 154(b) by 443 days.

(21) Appl. No.: 13/200,521

(22) Filed: Sep. 26, 2011

(65) Prior Publication Data

US 2012/0081260 A1 Apr. 5, 2012

Related U.S. Application Data

(60) Provisional application No. 61/404,257, filed on Sep. 30, 2010.

(51) Int. Cl.
*H01Q 9/28* (2006.01)
*H01Q 19/10* (2006.01)

(52) U.S. Cl.
CPC ..... *H01Q 9/285* (2013.01); *H01Q 19/106* (2013.01)
USPC ..... 343/807; 343/795

(58) Field of Classification Search
CPC ..... H01Q 19/106; H01Q 9/285
USPC ..... 343/795, 807, 808
See application file for complete search history.

(56) References Cited

U.S. PATENT DOCUMENTS

| | | | | |
|---|---|---|---|---|
| 2,559,148 | A * | 7/1951 | Ercolino | 343/795 |
| 2,631,235 | A * | 3/1953 | Sheriff | 343/794 |
| 2,827,628 | A * | 3/1958 | Swinehart et al. | 343/806 |
| 3,721,990 | A * | 3/1973 | Gibson et al. | 343/726 |
| 4,251,818 | A * | 2/1981 | Lander | 343/819 |
| 4,860,019 | A * | 8/1989 | Jiang et al. | 343/795 |
| 8,054,237 | B2 * | 11/2011 | Suleiman et al. | 343/808 |
| 2005/0116873 | A1 * | 6/2005 | Soler Castany et al. | 343/795 |
| 2006/0077101 | A1 * | 4/2006 | Puente Baliarda et al. MS | 343/700 |

* cited by examiner

*Primary Examiner* — Tho G Phan

(57) ABSTRACT

This invention discloses a design and fabrication of a high performance HDTV Antenna to receive public airwave signals. The subject antenna consists of a high efficient broadband element and a pair of reflecting surfaces. The reflecting surfaces produce a focusing effect. The backside radiation of the antenna is redirected, making it more energized to receive signals from the front side. This is a very desirable feature in a weak signal environment. The reflecting surfaces provide additional benefits in reducing unwanted multiple reflecting signals which often cause unstable pictures. The broadband radiating element composed a pair of triangular shape radiators which is excited by a new art infinite balun. With this design, it is unnecessary to reposition the antenna in order to receive all available public channels. A fixed location is generally adequate to provide good reception to all stations.

10 Claims, 1 Drawing Sheet

HIGH PERFORMANCE HDTV ANTENNA DESIGN AND FABRICATION

CROSS-REFERENCE TO RELATED APPLICATION

This application claims the benefit of U.S. Provisional Application No. 61/404,257 filed on Sep. 30, 2010.

FIELD

Present disclosure provides new arts in design and fabrication of antennas to receive public airwaves signals specifically relates to television antenna.

BACKGROUND

TV transmission in the past for the most part has always been in analog. High gain antennas were required. TV antennas were either Log Periodic or Yaqgi designs. These antennas are physically large and often require mounting on poles outside the house or building. For HDTV, the transmission signals are digitized and spread over a wide band; only very low detectable signals are required for HDTV reception. As a result, only low gain and broad coverage antennas are required for HDTV reception.

The HDTV signals are transmitted over the UHF and occasionally VHF band. The antenna design addressed in this disclosure is physically small, requiring no external power. The art of the design is broad band and providing a uniform coverage over the transmission band. The desirable features are evident in the invention antenna. Current antenna art lacks broad band performance and also lack of abilities to reduce inference signals from its surrounding objects.

DRAWINGS

Figure 1:
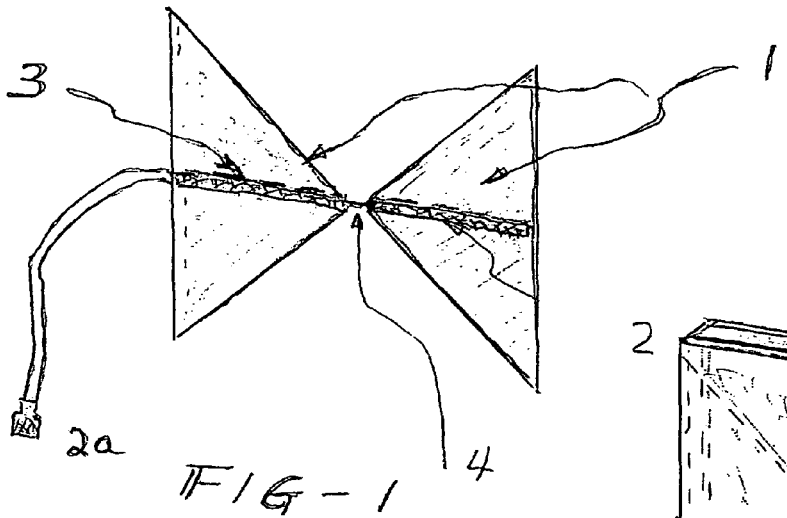

FIG. 1—Radiating Element

FIG. 1 is a perspective view of one preferred embodiment of the subject invention containing a pair of triangular shape element radiators 1 which is excited by a coaxial transmission line of RG59/U 2 and an F male connector 2*a*. The outer jacket of the coaxial line is removed and the entire line is soldered to the triangular element as shown in 3. At the vertex of the triangle radiator, the center conductor is cross connected to form an infinite balun 4.

Figure 2:
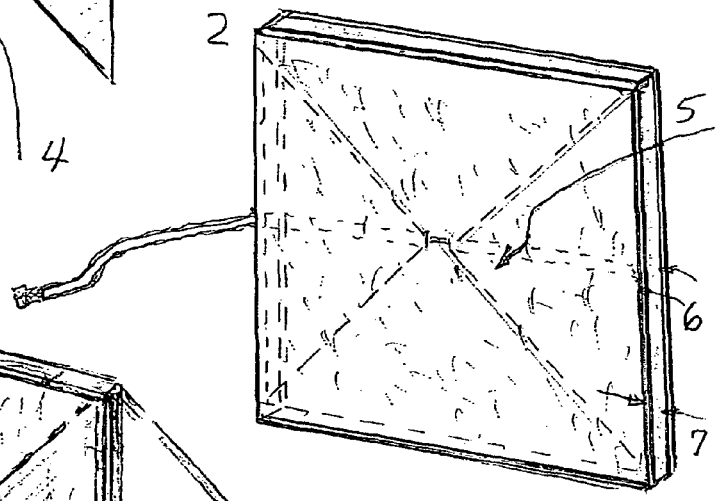

FIG. 2—Radiating Element in Enclosure

FIG. 2 is a perspective view of invention antenna radiating element housed in a shallow cavity 5. The cavity front and back surfaces 6 are square of 9 inches sides. The cavity side walls 7 are 9 inches by ½ inch. The entire cavity was fabricated by bonding Abs plastic parts with 4SC solvent. Wood panels may also be used instead of plastic for fabrication of the cavity. The antenna would perform well for both materials. The FIG. 2 assembly without the reflecting surfaces can be operated in a standing position, hanging on a wall, or simply laid flat on a supporting surface.

Figure 3:
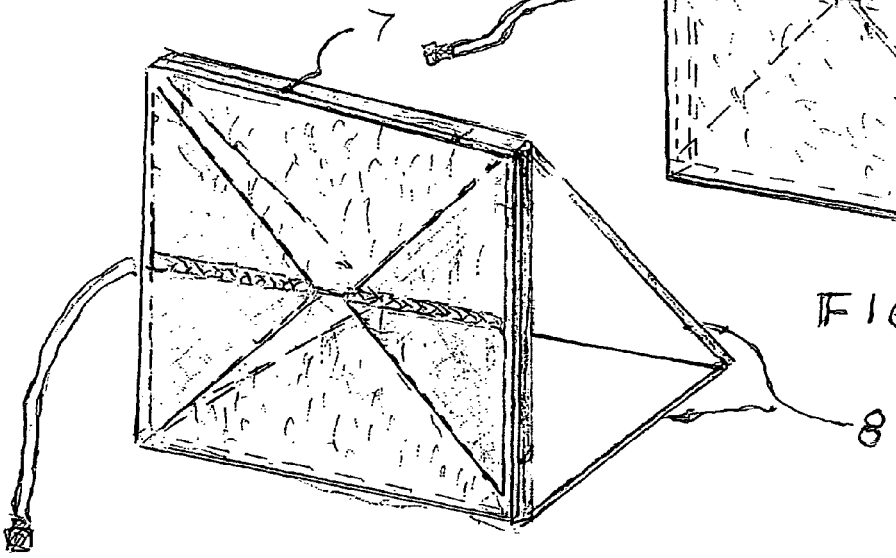

FIG. 3—Radiating Element and Reflecting Surfaces

FIG. 3 is a perspective view of invention antenna with its reflecting surfaces 8 inserted to form 60 degree corner reflector structure. The reflecting surfaces provided focusing effects and also reduced multiple reflections that are often affecting the TV pictures. The broadband triangle element, infinite balun, and reflecting surfaces are the unique features of the invention antenna.

DETAILED DESCRIPTION

Invention antenna consists of a unique high efficiency broadband element which is excited by a unique infinite balun (balanced-to-unbalanced converter) and a pair of reflecting surfaces to help focus the HDTV signals.

Antenna Radiating Element Design

In our discussion of the operating theories, the antenna can be considered as a radiator or a receiving element. The antenna performance characteristics in both modes are identical. Quite often the antenna can be explained and understood as a transmitting device. Unlike todays art, for radiating elements such as rabbit ears, loops, and dipoles the radiating element which is the invention described here is composed of two triangles of metal surfaces that are positioned facing one another, see FIG. 1. The vertex angles of the triangle elements are 90 degrees. The base angles are 45 degrees. The tips are separated by less than ⅜ of an inch. The antenna elements are housed in a shallow cavity.

The metal triangles are fabricated from sheet metals but can also be implemented into circuit board by means of an etching technique.

It should be noted that the vertex angle of 90 degree can be changed to greater or smaller angles. However, any angle differ from 90 degree will alter the physical dimensions of the aperture and the corresponding antenna will not be square as noted in the disclosure antenna. As the vertex angle of the triangle element decrease, the antenna length needs to be increased accordingly in order to maintain the desire antenna bandwidth performance FIG. 1 shows the radiating element excited symmetrically by a coaxial cable (RG59/U). With the exterior removed, the outer shield of the cable is electrically connected to the input side of the triangle element. The center conductor is electrically connected to the conjugated triangle through the apex. The coaxial excitation in this way forms an infinite balun to obtain a good impedance match over a wide frequency band. This is an essential design feature for good reception of HDTV signals.

The coaxial cable can be soldered, spot welded, or mechanically fastened to the radiating element for a good electrical connection. The coaxial cable of this invention antenna was soldered to the triangle element.

It should be noted that the balun approach taken here has eliminated the need of a normal twin lead transmission line connection to excite the symmetrical radiating structure. The coaxial cable is also being part of the radiating structure; it has provided good impedance match to low end of the frequency band beyond the triangle element alone.

An F male connector is connected at the input of the coaxial cable as shown in FIG. 1.

The return loss for the antenna models tested were greater than 15 dB over the frequency band of 50 megahertz to 1000 megahertz.

The antenna models that have been made and tested were 9 and 10 inch square apertures. A rectangle aperture of this design can also be expected to perform well. The apex angle of the rectangle design, however, will be less than 90 degrees.

The radiating element of this invention is a unique design in producing broad band performance. For high frequencies, the antenna is resonated near the apex, and for low frequencies the antenna is resonated at the far end of the triangle element.

Antenna Enclosure

The antenna element is encapsulated in a shallow cavity which is fabricated from Abs plastic sheets of ⅛ and 1/16 inch thick. The cavity side walls are formed by bonding several ¼ inch width strips. The envelope dimensions are 9 inch by 9 inch by ½ inch. With this design, excellent performance has been obtained. The cavity body can be made from wood panels as well.

Antenna Reflecting Surfaces

The pair of reflecting surfaces in use is of the same size as the radiating aperture, see FIG. 3. The surfaces are configured to clip on and detach easily. The antenna can be operated with the reflecting surfaces detached. When the reflecting surfaces operated as a focusing device, the surfaces are clipped on to form a 60 degree corner reflector. This is a very desirable feature to enhance the antenna's front coverage in receiving marginal signals. It is also helping to reduce the multiple reflection effects from the surrounding objects that are often a cause of unstable pictures.

For a strong signal situation, the antenna can be operated with its reflecting surfaces detached from the antenna body, then, the antenna can hanging on a wall, or simply laid flat on a supporting surface or on a stand.

The reflecting surfaces can be implemented by using a metal spraying technique or by bonding a thin metal sheet on a supporting surface.

Antenna Coverage Pattern

The basic coverage of this disclosure antenna is a broad omnidirectional toroid shape pattern. The axis of the pattern is oriented along the coaxial cable. The antenna polarization is linear and the field lines run parallel to the coaxial line.

The invention claimed is:

1. An antenna structure comprising: a pair of radiating polygonal radiating elements positioned such that one is opposing the other along the vertex, a coaxial cable positioned such that it runs along the two radiating elements and overlapping the two reflecting vertices characterized in that the coaxial outer conductor has a gap separating it into two parts at the location where the two vertices meet, one part of the outer conductor is electrically connected to one radiating element and the center conductor is electrically connected to the conjugate radiating element forming an infinite balun, and a corner reflector positioned on one side of the plane formed by two radiating elements, the corner reflector comprising of two reflecting elements joined along one side and having a corner angle of 60 degrees.

2. The antenna structure in claim 1, wherein the two polygonal radiating elements are congruent and one is positioned as a reflection of the other along the vertex.

3. The antenna structure in claim 1, wherein the two polygonal radiating elements are triangles.

4. The antenna structure in claim 3, wherein the two triangle elements are right isosceles triangles and the reflection vertex is 90 degree angle.

5. The antenna structure in claim 1, wherein the corner angle can be varied between 50 degrees and 70 degrees.

6. A method of exciting a pair of polygonal radiating elements comprising: electrically connecting the outer conductor of a coaxial cable to one radiating element, electrically connecting the center conductor of the coaxial cable to the conjugate radiating element forming an infinite balun, arranging the radiating elements such that one opposing the other along a vertex and with the opposing vertex beneath the coaxial cable, and removing a part of the outer of the coaxial at the location where the opposing vertices meet and attaching a corner reflector positioned on one side of the plane formed by two radiating elements, the corner reflector comprising of two reflecting elements joined one side and having a corner angle of 60 degrees.

7. The method in claim 6, wherein the two polygonal radiating elements are congruent and one is positioned as a reflection of the other along the vertex.

8. The method in claim 6, wherein the two polygonal radiating elements are triangles.

9. The method in claim 8, wherein the two triangular elements are right isosceles triangles and reflection vertex is 90 degree angle.

10. The method in claim 6, further comprising adjusting the corner angle between 50 degrees and 70 degrees.

* * * * *